US009533237B2

(12) United States Patent
Testa

(10) Patent No.: US 9,533,237 B2
(45) Date of Patent: Jan. 3, 2017

(54) DEVICE FOR A SPECIAL EFFECT EXPLOSION OR BURST

(71) Applicant: 8879192 CANADA INC., West Vancouver (CA)

(72) Inventor: Martin Timothy Testa, Maple Ridge (CA)

(73) Assignee: 8879192 CANADA Inc., West Vancouver, British Columbia (CA)

( * ) Notice: Subject to any disclaimer, the term of this patent is extended or adjusted under 35 U.S.C. 154(b) by 0 days.

(21) Appl. No.: 15/101,863

(22) PCT Filed: Dec. 5, 2014

(86) PCT No.: PCT/CA2014/051177
§ 371 (c)(1),
(2) Date: Jun. 3, 2016

(87) PCT Pub. No.: WO2015/081447
PCT Pub. Date: Jun. 11, 2015

(65) Prior Publication Data

US 2016/0303488 A1 Oct. 20, 2016

Related U.S. Application Data

(60) Provisional application No. 61/912,728, filed on Dec. 6, 2013.

(51) Int. Cl.
*A63J 7/00* (2006.01)
*A63J 5/02* (2006.01)
*A63J 5/04* (2006.01)

(52) U.S. Cl.
CPC .... *A63J 7/00* (2013.01); *A63J 5/02* (2013.01)

(58) Field of Classification Search
CPC ..... A63J 5/00; A63J 5/023; A63J 5/04; A63J 7/00; A63H 33/00; A63H 33/30; F41H 5/0471; F41H 5/02; F41H 11/00; F41H 11/02
USPC ..... 472/59, 66, 137; 2/2.5; 446/473
See application file for complete search history.

(56) References Cited

U.S. PATENT DOCUMENTS 2,942,246 A 6/1960 Lombardi
3,198,117 A 8/1965 Purdy
4,917,372 A 4/1990 Zeitlin
5,647,924 A * 7/1997 Avory et al. ..... C06B 33/06 102/202.8

(Continued)

OTHER PUBLICATIONS

International Search Report dated Mar. 9, 2015 for PCT/CA2014/051177.

*Primary Examiner* — Kien Nguyen
(74) *Attorney, Agent, or Firm* — Knobbe, Martens, Olson & Bear, LLP

(57) ABSTRACT

A harness for receiving a special effects squib charge includes: a substantially planar base bound by opposing first and second surfaces joined at a perimeter; a tubular sidewall extending from the first surface of the base to form a tubular receptacle; an inward extension from the tubular sidewall defining a receiving aperture, the receiving aperture sized to be elastically deformed to allow insertion of the squib charge; and the distance between the base and the inward extension sized to be substantially equal to the axial length of the squib charge. A bullet hit device includes the harness, and a kit is for assembly and/or use of the harness as a bullet hit device.

20 Claims, 4 Drawing Sheets

(56) References Cited

U.S. PATENT DOCUMENTS

| | | | | |
|---|---|---|---|---|
| 8,069,494 | B2 * | 12/2011 | Sundnes | A41D 31/0061 2/2.5 |
| 2008/0070476 | A1 | 3/2008 | Warshaw | |

* cited by examiner

DEVICE FOR A SPECIAL EFFECT EXPLOSION OR BURST

CROSS REFERENCE TO RELATED APPLICATIONS

This application is the U.S. National Phase of International Application No. PCT/CA2014/051177, filed Dec. 5, 2014, designating the U.S. and published in English as WO 2015/081447 on Jun. 11, 2015 which claims the benefit of U.S. Provisional Patent Application No. 61/912,728 filed Dec. 6, 2013. Any and all applications for which a foreign or domestic priority claim is identified here or in the Application Data Sheet as filed with the present application are hereby incorporated by reference under 37 CFR 1.57.

BACKGROUND OF THE INVENTION

1. Field of the Invention

The present invention relates generally to special effects technology, and more particularly mechanical special effects for controlled and illusory explosions or bursts.

2. Description of the Related Art

Special effects (often abbreviated as SFX, SPFX, or simply FX) are illusions used in staged settings or productions such as film, television, theatre, video game, simulator industries, and the like to simulate imagined events in a story or virtual world.

Mechanical special effects (also known as physical special effects) use tangible compounds, compositions, machines and devices such as mechanized props, makeup, prosthetics, scenery, scale models, animatronics, pyrotechnics, atmospheric effect machines, explosive charges and the like to create a controlled illusion of physical phenomenon such as wind, rain, fires, explosions, shootings, injuries, crashes and the like. Furthermore, mechanical special effects are distinguishable from in-camera photographic special effects or computer generated special effects in that mechanical special effects accomplished during live-action filming or live-action productions can be apparent to the actors and other participants, and pose a safety risk to these actors and other participants.

An illusory bullet hit device is a mechanical special effects device that provides an illusory explosion or burst of a flowable material such as a liquid, paste, granulated solid or powdered solid to mimic the impact of a bullet shot hitting a base surface such as a human, a wall, a road, etc. A common technique for creating an illusion of a bullet hitting a base surface is to attach an electrically ignited detonator also known as a squib (such as disclosed in U.S. Pat. No. 3,198,117 issued 3 Aug. 1965) to the base surface and coupling a rupturable pouch filled with flowable material to an exposed surface of the detonator/squib so that when the detonator/squib is triggered by a pyrotechnic controller the explosion ruptures the pouch and splatters or sprays the flowable material away from the base surface. In a more specific example, using an illusory bullet hit device to create an illusion of a bullet impact puncturing an actor's skin comprises attaching the detonator/squib to a desired location on an under garment worn on the actor's body with the detonator/squib backed by a metal plate to shield the actor's body from explosive force, and coupled on its outward face to a pouch containing fake blood. The actor's costume is worn over these components and coupled to the pouch containing fake blood so that when the detonator/squib is electrically triggered the resulting explosion ruptures the pouch splattering the fake blood contents away from the actor's body and onto and/or through the actor's costume resulting in staining of the actor's costume. Optionally, the actor's costume may be pre-scored or distressed in alignment with the detonator/squib so that in addition to splattering the fake blood, the explosion produces a hole in the actor's costume allowing the fake blood to eject through the hole, thereby creating an illusion of skin puncture and a bullet hole in the actor's costume. Such techniques have been previously described, for example, in U.S. Pat. No. 2,942,246 (issued 21 Jun. 1960), U.S. Pat. No. 4,917,372 (issued 17 Apr. 1990), and US Patent Application Publication No. 2008/0070476 (published 20 Mar. 2008).

During use of illusory bullet hit devices safety and consistency have been long held concerns: safety of actors and other participants wearing or surrounding the devices during detonation; and consistency, reproducibility or predictability of a splatter or burst effect. Despite the recognition of these concerns many bullet hit devices continue to be hand-made and constructed in an ad-hoc fashion, and do not sufficiently address safety and consistency concerns.

Accordingly, there is a continuing need for alternative devices for special effects explosions or bursts.

SUMMARY OF THE INVENTION

In an aspect there is provided, a harness for receiving a special effects squib charge, comprising:

a base bound by opposing first and second surfaces joined at a perimeter;

a tubular sidewall extending from the first surface of the base to form a tubular receptacle;

an inward extension from the tubular sidewall defining a receiving aperture, the receiving aperture sized to be elastically deformed to allow insertion of the squib charge; and the distance between the base and the inward extension sized to be substantially equal to an axial length of the squib charge.

In a further aspect, a kit comprising the harness and instructions for assembly and/or use is provided.

DETAILED DESCRIPTION OF PREFERRED EMBODIMENTS

Terms top, bottom, front, back may be used to describe surfaces of a bullet hit device or components therein. The terms top and front are used interchangeably to describe a surface of the harness that provides a receptacle for housing a squib charge, while the back and bottom interchangeably reference the opposing surface of the harness. Top/front or bottom/back surfaces of other components are consistent with the orientation provided by the harness.

Figure 1:
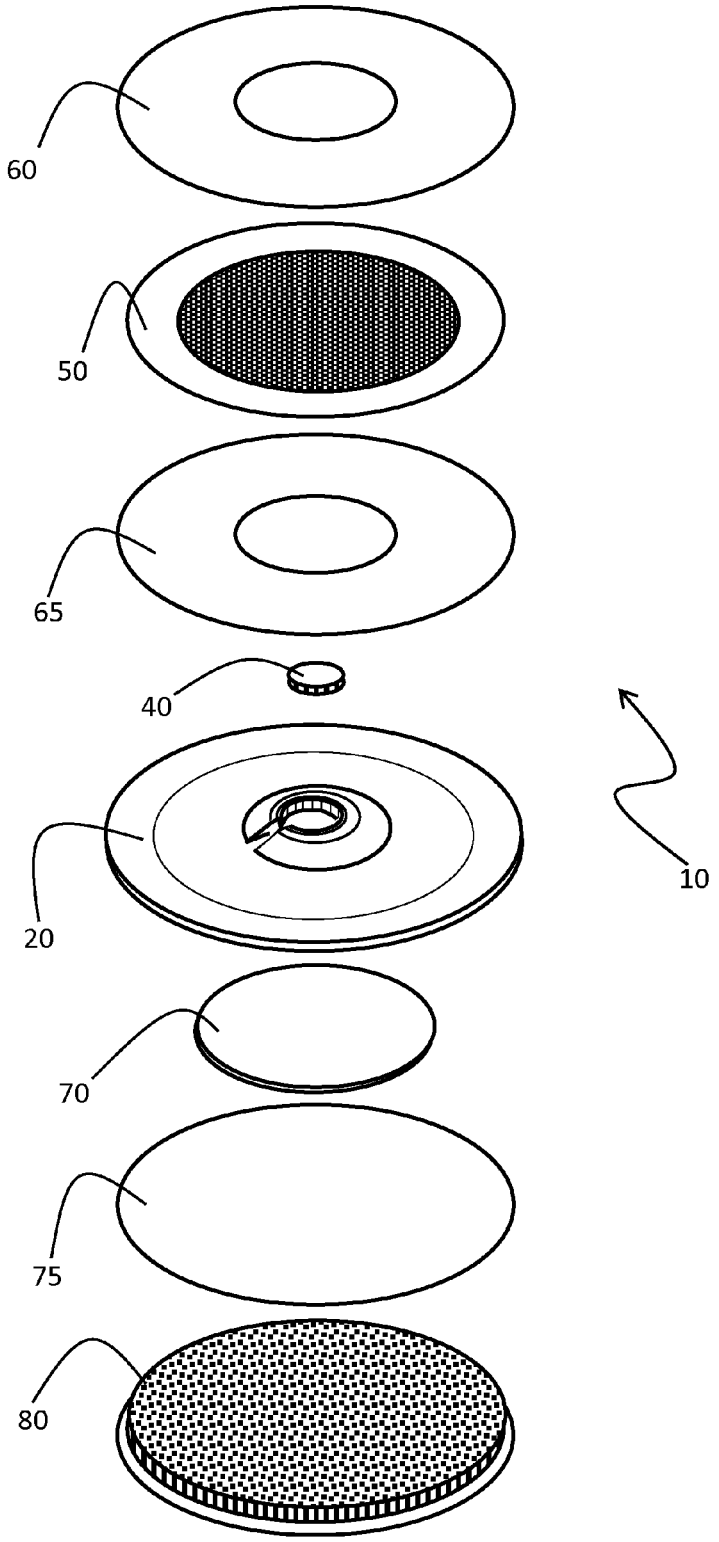
FIG. 1 shows an exploded perspective view of an illustrative example of an illusory bullet hit device.

Referring now to the drawings FIG. 1 shows an exploded view of a bullet hit device 10. The bullet hit device 10 comprises a harness 20 providing a centrally located receptacle for housing a squib charge 40, a plastic bag 50 filled with a special effect blood medium coupled to a front side of the harness, and a metal plate 70 and a foam pad 80 coupled to a back side of the harness. First and second O-ring double-sided mounting tapes 60 and 65 are attached to opposing surfaces of the plastic bag 50. The first O-ring double-sided mounting tape 60 is used to couple a first surface of the plastic bag 50 to an interior surface of an actor's costume. A second O-ring double-sided mounting tape 65 is used to couple a second surface of the plastic bag to the harness 20. A solid circular double-sided mounting tape 75 is used to couple the metal plate 70 and the foam pad 80 to the harness 20. The foam pad can have an adhesive backing to attach to an actor's under-garment or to an actor's skin.

Figure 2:
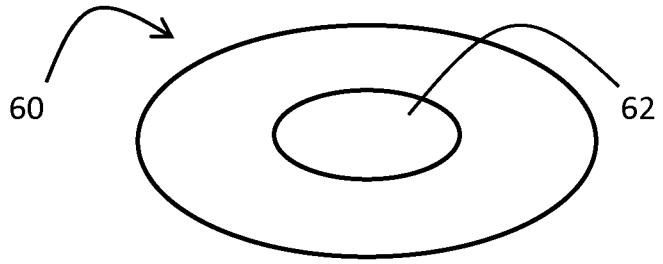
FIG. 2 shows a perspective view of a first O-ring mounting tape from the device shown in FIG. 1.

FIG. 2 shows a perspective view of the first O-ring double sided mounting tape 60. The first O-ring double sided mounting tape 60 comprises first and second adhesive surfaces covered with removable backing paper and defines a central aperture 62 that is sized to be larger than a radial cross-sectional area of the squib charge 40 and smaller than the first surface of the plastic bag 50. The purpose of the first O-ring double-sided mounting tape 60 is to attach the bullet hit device 10 to an interior surface of an actor's costume so it can be located for use. The central aperture 62 allows for special effects medium exploding from a ruptured plastic bag 50 to splatter without being restricted by the tape 60.

Figure 3:
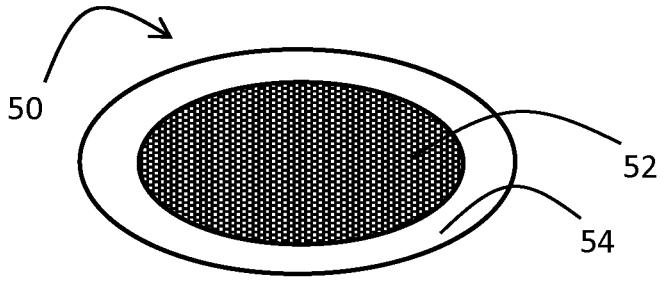
FIG. 3 shows a perspective view of a special effect medium bag from the device shown in FIG. 1.

FIG. 3 shows a perspective view of the plastic bag 50. The plastic bag 50 comprises a central pouch 52 that can be filled to contain various special effects mediums such as replicated blood or dust or powder. The plastic bag 50 comprises two opposing plastic sheets sealed along their perimeter 54 to provide a central pouch 52 to securely hold a desired special effects medium. Any conventional technique of filling and sealing plastic bags may be used to prepare plastic bag 50. The thickness of the plastic bag is chosen to allow predictable and desirable rupture of the plastic bag 50 by the force of the exploding squib charge 40 and propulsion of the special effects medium away from the actor.

Figure 4:
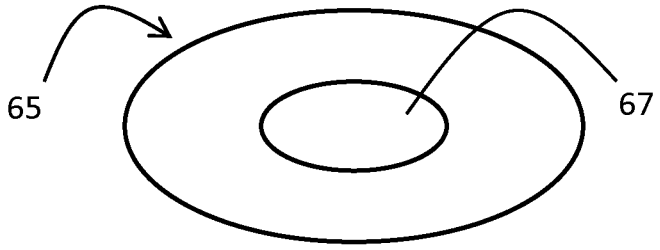
FIG. 4 shows a perspective view of a second O-ring mounting tape from the device shown in FIG. 1.

FIG. 4 shows a perspective view of the second O-ring double sided mounting tape 65. The second O-ring double sided mounting tape 65 comprises first and second adhesive surfaces covered with removable backing paper and defines a central aperture 67 that is sized to be larger than a radial cross-sectional area of the squib charge 40 and smaller than the second surface of the plastic bag 50. The purpose of the second O-ring double-sided mounting tape 65 is to attach the second surface of the plastic bag 50 to the harness 40 in order to secure the parts and allow the blast of the exploding squib charge to impact the plastic bag 50 directly. The central aperture 67 allows the blast of the squib charge 40 to impact the plastic bag 50 without interference from an adhesive surface of the second O-ring double sided mounting tape 65.

Figure 5:
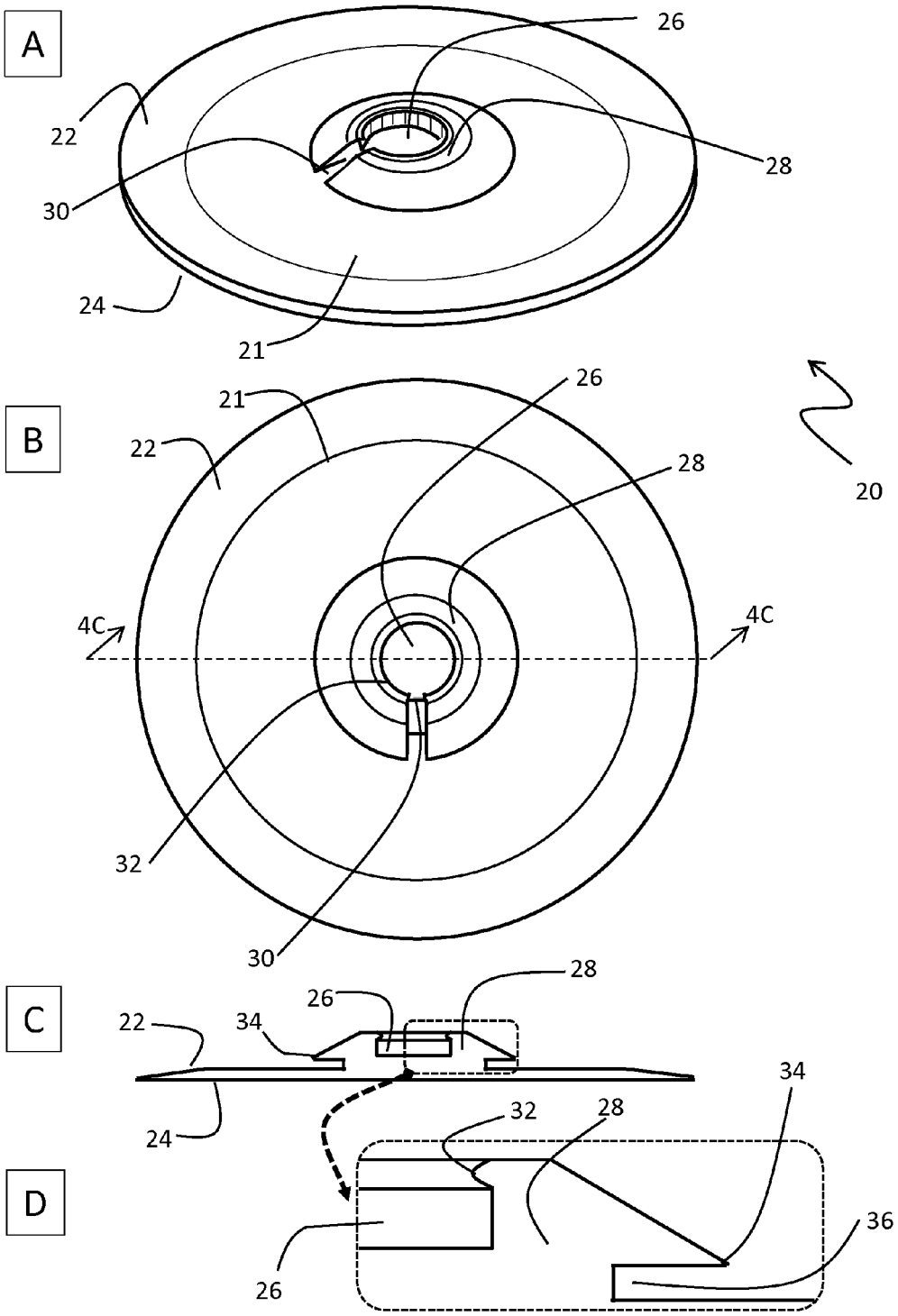
FIG. 5 shows a perspective view (A), a top plan view (B), an axial cross-section view along the line 4C-4C (C), and a cut-away magnified view (D) of a harness from the device shown in FIG. 1.

FIG. 5 shows a perspective view of the harness 20. The harness 20 comprises a substantially planar base 21 bound by substantially planar and opposing front 22 and back surfaces 24. A tubular receptacle 26 for receiving and housing the squib charge 40 is formed by a sidewall 28 extending axially from the base 21. The tubular receptacle 26 is bound by the base 21 and the sidewall 28 with the rim of the sidewall providing a receiving aperture for inserting the squib charge 40 into the tubular receptacle 26. The sidewall 28 is substantially continuous in forming the tubular receptacle 26 except for a sidewall aperture 30 formed in the sidewall 28 to allow electrical wires from the squib charge 40 to exit the tubular receptacle 26. The sidewall aperture 30 is a channel or gap in the sidewall 28 that runs the entire axial length of the sidewall 28.

An inward extension 32 of the sidewall 28 distal from the base 21 is shown as a flange-like projection extending from the rim of the sidewall 28 in towards a central axis of the tubular receptacle 26. The inward extension 32 defines the receiving aperture for squib charge 40. As a squib charge 40 is inserted into tubular receptacle 40 the inward extension 32 and/or the sidewall 28 may be elastically deformed to move from a closed position to an open position to allow the squib charge 40 to pass through the receiving aperture and be seated on the base 21. Once the squib charge 40 is in place the elastically deformed inward extension 32 and/or sidewall 28 can move from the open position to a closed position to capture the squib charge 40. A typical squib charge 40 comprises first and second end walls joined by a shaft therebetween. When captured in the tubular receptacle 26 a first end wall of the squib charge receives abutting support from the base 21, the shaft of the squib charge 40 contacts the sidewall 28, and the second end wall of the squib charge 40 abuts and is retained by the inward extension 32. Thus, the distance between the inward extension 32 and the base 21 at the tubular receptacle 26 is typically sized to accommodate the axial length of the squib charge 40. The retaining function of the inward extension 32 provides a significant safety benefit as the seating of the squib charge 40 becomes consistent and reliable, avoiding the dangers of on-site gluing or taping of squib charge 40 to a base.

An outward extension 34 of the sidewall 28 proximal to the base 21 is shown as flange-like projection extending from the sidewall substantially parallel and proximal to the base 21. The portion of the sidewall located between the outward extension 34 and the front surface 22 of the base 21 provides a spooling surface 36 for winding excess lengths of electrical wire from the squib charge 40 before directing a desired length of electrical wire towards the periphery of the base to be connected to a trigger controller. Winding excess lengths of electrical wire around spooling surface 36 and then using the second O-ring double sided mounting tape 65 to fix the desired length of electrical wire that is radially directed to the periphery of the base 21 provides a significant safety benefit by preventing a stray length of wire from resting in the path of a detonation by squib charge 40.

The harness 20 can be made from poly vinyl chloride (PVC) injected into a mold and formed to hold and direct the blast of the squib charge 40. The squib charge 40 is activated electrically by attached wires connected to a trigger controller. The harness 20 is formed with specific structures, such as the tubular receptacle 26, the sidewall aperture 30 and the spooling surface 36, functioning to hold not just the squib charge, but also the attached electrical wires so they are conveniently and predictably secured and available.

Figure 6:
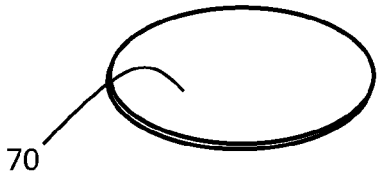
FIG. 6 shows a perspective view of a metal plate from the device shown in FIG. 1.

FIG. 6 shows a perspective view of the metal plate 70. The metal plate 70 is a protective shield sized to be larger than the radial cross-section of the tubular receptacle 26 and aligned to fully cover the back surface 24 of the base 21 of the harness 20 at the tubular receptacle 26 to provide a high margin of safety and comfort for the actor. The metal plate 70 directs the energy of the exploding squib charge 40 away from the actor's body and towards the actor's costume. The metal plate 70 is an energy deflecting component of the assembled bullet hit device 10. The metal plate 70 is thick enough to protect the actor and thin enough to allow the entire assembly to be thin enough to conceal beneath an actor's costume.

Figure 7:
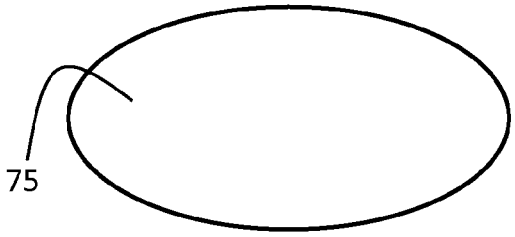
FIG. 7 shows a perspective view of a solid circle mounting tape from the device shown in FIG. 1.

FIG. 7 shows a perspective view of the solid circular double-sided mounting tape 75. This is another layer of double sided tape which attaches both the metal plate 70 and the foam pad 80 to the back surface 24 of the harness 20.

Figure 8:
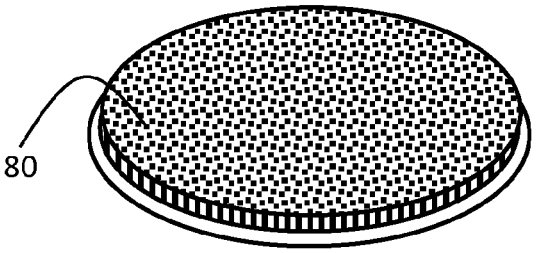
FIG. 8 shows a perspective view of a foam pad from the device shown in FIG. 1.

FIG. 8 shows a perspective view of the foam pad 80. The foam pad 80 is a shock-absorbing component intended to increase the comfort of the actor and reduce the impact of the exploding squib charge 40 when detonated.

Various combinations of the components shown in FIGS. 2 through 8 may be packaged in a kit with instructions for their assembly and use. The components can be categorized by function, for example, adhesive components, shock-absorbing components, an explosive charge harness, a wiring guide, and a bag for theatrical effects "blood" or dust.

Adhesive Components.

Double-sided tapes of pre-determined size, shape and perforation may be provided within a kit. Double-sided tapes can hold components of the bullet hit device together to form the functioning kit without impacting the performance and predictability of the explosive effect and propelled special effects medium. The double-sided tape can also hold the assembled bullet hit device to the inside of the actor's clothing in order to conceal the assembly.

Adhesive components can serve 3 purposes; hold individual parts of the assembled kit together; function to attach the assembled kit to bodies or objects; performs both of these functions while at the same time assuring the reliable and safe functioning of the kit. In one example, the kit can comprise 3 pieces of adhesive. The first adhesive component is at the front of the assembled kit allows attachment of the plastic bag 50 to the inside of an actor's costume. This first adhesive component is a circle-shaped piece of tape 3.25 inches in diameter. The second adhesive component holds the plastic bag 50 to the harness 20, and is the generally similar in shape as the first adhesive component, but slightly smaller in diameter. The third adhesive component is located between the harness 20 and the foam pad 80 and traps the metal plate 70 to the harness 20 and at the same time fastens the foam pad 80 to the back surface 24 of the harness 20. The double-sided tape can be created with a strong pressure sensitive adhesive making it effective at sticking to many surfaces without falling off unintentionally. The tapes are sized in order to couple the individual pieces together. They are perforated or shaped with centrally located apertures so that the contents of the plastic bag 50 are propelled by the exploding squib charge 40 in the intended direction. Cut-out apertures or perforations of the adhesive tape may be modified depending on the application in order to avoid unintended flight of the contents of the bag that create wasted or possibly dangerous shots. Double-sided adhesive tapes may employ a removal film on the sides of the assembled kit, for example a back surface of the foam pad 80 or a front surface of the plastic bag 50 that can be attached to bodies or objects. By removing the peel away film covering the pressure sensitive adhesive the user may attach the fully assembled kit from either side.

The adhesive can be made stronger or weaker depending on the requirements of the user. It could be made with additional padding to augment the performance of the shock absorbing components of the kit. The perforation and/or central apertures in the tape may be made bigger or smaller in order to deliberately effect the performance of the exploding bag contents. Because the bag can contain fluids, powders, dust, feathers, or other media, the size of the cut out in the tape can create differing effects as desired.

Double-sided tapes could be replaced with separately applied glues of varying specifications for specialty applications if desired.

Shock Absorbing Components.

The metal plate 80 can be provided as a disc of solid steel in the shape of a large coin that is affixed with the adhesive tape to the back of the harness 20. Another shock absorbing component is the foam pad 80 which can be a semi-rigid foam rubber disc which becomes the component immediately adjacent to the user. The combination of the steel plate 70 and foam pad 80 direct the force of the exploding hit away from the user and through the plastic bag 50 so as to create the effect of a bullet hit without harming the user.

In one example, the steel plate can be a stamped piece of industrial steel sized to shield the back of the assembled kit from the exploding squib charge 40, and to direct the projected contents of the plastic bag 50 in the intended direction. This steel plate may vary in thickness and diameter, but for illustration purposes a suitable steel plate may be 0.19 inches thick and 1.9 inches in diameter. While shape is not critical, it is often round and resembles a coin. It is rigid enough strong enough to guarantee that it will not be perforated by the exploding squib charge, but light enough that the assembled kit is easily concealable on the inside of a garment. If it were too heavy, the attached kit would cause the garment to which it is attached to noticeably sag.

Another shock absorbing component, the foam pad 80 may be shaped as desired depending upon the application. In an example, the foam pad can be a foam rubber disc, 3.25 inches in diameter and ⅛th of inch thick. This foam pad increases the comfort of the experience when the squib charge is detonated.

The metal plate 70 can be made of any suitable metal like steel, brass or aluminum depending on the specific requirements of the technician. It can vary in thickness and diameter if a variant of the size of the squib charge requires more or less shielding. The metal plate could also be constructed of carbon fiber or kevlar or some other shielding material that might serve the function of protecting the wearer and directing the blast in the intended direction. Thus, the plate may be called a shielding plate and may be devoid of metal. For example, a shield plate made of kevlar with a plastic backing with no added metal could provide suitable protection. The metal plate, and more generally the shield plate, can be made of materials of varying rigidity and varying hardness depending on the specific application.

The foam pad can be made larger in diameter and thicker or thinner should there be some benefit for a given project. The foam pad could be replaced by a less malleable material for use on other than human wearers. For hard surfaces, the foam pad may be deleted entirely or replaced with another material altogether.

Theatrical Effects Bag.

The plastic bag 50 can be constructed from two sheets of plastic in the shape of a hollow pancake where the perimeter edges are welded together creating a pocket or pouch in the center. This pocket is filled with the theatrical effects medium and then sealed to hold the medium in place.

The plastic bag 50 functions to hold special effects media in close proximity to the explosive squib charge 40 so that upon detonation of the squib charge 40 the special effects media contents held in the plastic bag 50 will be propelled outward creating an effect that resembles the impact of a bullet or piece of shrapnel. The plastic bag 50 is similar to a vacuum sealed plastic bag but is heat welded closed around its perimeter sealing in the various contents of special effect media. When sealed around the edges, a pocket is created in the middle of the bag and this pocket is what holds the special effect medium.

Theatrical blood is a common medium for special effects and the kit may be available with bags pre-filled with theatrical blood. In an example, when filled, the plastic bag 50 resembles a round tea bag with diameter of 3 inches and a thickness of approximately ¼ inch. These bags are sized to mate to the non-shielded side (the front) of the assembled kit, but could be used independently of the rest of the kit for other purposes. The thickness, composition and properties of the plastic may be varied with the desired contents to be held or other parameters of an application. In an example, the plastic is similar to plastic used in the sandwich bag technology. In another example, the bag can be made of stretchable latex material such as is used in condom technology. Generally, conventional techniques and materials from the bag, packaging or condom industries may be used to construct the plastic bag. In another example, the plastic is 1.5 mil thick. The thickness can be as much as 4 mil if required.

The plastic bag can be made of varying thickness of plastic or other materials. It may also be made in varying diameters and with pockets of differing capacities.

Harness.

In an example, the harness 20 is a molded plastic component shaped like a disc with a molded receptacle for the explosive squib charge and a molded channel to securely hold the wires attached to the squib charge. It functions as a reliable, predictable, quickly assembled container for the squib charge and attached special effects bag.

The harness may be a molded piece of plastic designed to hold the explosive squib charge in a central location and also be the attachment point for other elements of the assembled kit. The harness has a centrally located molded receptacle which functions to reliably hold the explosive squib charge and provide a grooved receptacle rr spooling surface to hold the wires that are communicative with the electrically activated squib charge. In an example, the harness is a disc shaped element 3.25 inches in diameter and varies in thickness across its section. The thinnest part at the edges is 1/16th of an inch thick and the thickest part in the center where the squib charge is mounted has a thickness of 0.3 inches. The centrally located tubular receptacle of the harness allows the explosion of the detonated squib charge to be directed in a consistent and predictable way into the special effects media held by the plastic bag 50.

Shape, size or color of the harness may be varied as desired to suit particular applications. Similarly, materials used or method of manufacture may be varied depending on application specifics.

If a technician desires a smaller or larger effect, the size of the harness could be increased or decreased. The tubular receptacle could be smaller or larger or varied in shape according to the specification of a chosen explosive squib charge. The harness could be made thinner or thicker and the color could vary to accommodate the specifics of an application. The harness could be configured to hold multiple hits and multiple special effects media containing plastic bags, and it could also be configured to hold a multi-hit squib charge wherein multiple charges are laid out in concentric circles to allow sequential hits at the same spot.

A bullet hit device or a kit for its assembly could be constructed of differing materials such as all metal or all plastic or any combination of metal and plastic. The harness could be made of metal, kevlar, carbon fiber, wood, or other synthetic materials or any combination thereof. It could also be made in different thicknesses and sizes to accommodate differing explosive squib charges and differing special effect media. In an example, a bullet hit device could be made into a series product where multiple squib charges and special effects media bags or containers are attached in a long or multi-layer harness and triggered in a pre-determined sequence so as to create a more elaborate effect.

In an example, a bullet hit device 10 or a kit for its assembly can be modified to accommodate squib charges that do not use explosive chemicals but rather compressed air or other compressed gasses. For example, the harness may be configured to house a compressed gas or compressed air adaptor. The harness may also be modified to include a heart rhythm blood expulsion pack and tube to pulse blood after an initial bloody bullet hit. The harness may also be modified to incorporate a wireless receiver for remote, wireless activation of the special effects squib charges if such a device becomes prevalent.

A bullet hit device or a kit for its assembly or any components thereof can be made with different attachment adhesives or mechanical attachment points for use on solid objects or in sand, dirt, or under water.

A bullet hit device or a kit for its assembly or any components thereof can be made lighter or heavier depending on the particular requirements of the application.

In operation, a bullet hit device 10 or a kit for its assembly is a manufactured multi-component assembly that replaces individually hand-made special effects "bullet hit squibs" assemblies commonly used in live action film and television.

The kit can be purchased by a customer partially assembled so that the harness, metal plate, and foam pad are already assembled. When the kit is removed from its container, a technician inserts the special effects explosive squib charge, and then runs the wires attached to the squib charge through a channel in the sidewall forming the tubular receptacle of the harness. The next step for the technician is to attach a suitable double-sided tape to the harness, then the plastic bag to the tape. Over the plastic bag the final mounting tape is attached and the entire assembled kit is then attached to the actor's costume. Adhesive backing of the foam pad can be used to also attach the assembled kit to the actor's under-garment or skin.

Once the explosive squib charge is mounted into the harness and the entire kit is assembled and attached to the actor or other object or surface, the explosive squib charge can be detonated when desired by the technician. Upon detonation, the explosive force is directed by the harness and metal plate into the plastic bag so that it tears through the bag and propels the contents to the front of the assembled kit. The controlled explosion of special effects media shows on camera like a bullet hit.

Once the squib charge has exploded and torn through the bag, the entire assembly may be discarded.

An illustrative example and several variants have been described above. Several variants and modifications will now be described. Still further variants, modifications or combinations thereof will be apparent to the person of skill in the art.

The components of the bullet hit device may be used together as shown in FIG. 1, but may also find use individually. For example, the harness 20 could be sold individually and incorporated into existing bullet hit devices. Similarly, the pre-packaged plastic bag 50, the metal plate 70 or the foam pad 80 could be sold individually and incorporated into existing bullet hit devices. Furthermore, any combination of the bullet hit device components such as the harness 20, the plastic bag 50, the metal plate 70, or the foam pad 80 may be sold as a kit. The kit may include instruction for use of the components to assemble a bullet hit device.

The harness may be made of any suitable material using any convenient method of manufacture.

The harness may be any shape or size including irregular shapes or sizes such as a shape and size that conforms to a body part. For example, a harness could be manufactured in a shape and size to follow the contour of an actor's torso.

The harness may comprise a single tubular receptacle or the harness may comprise a plurality of tubular receptacles. In an example, single harness may comprise 4, 5, 6, 7, 8, 9, or more tubular receptacles with squib charges captured within the plurality of receptacles operably connected to a triggering controller programmed to detonate the squibs in a pre-determined sequence. In another example, a harness comprising a plurality of tubular receptacles can be cut to a desired shape with a desired number of tubular receptacles. Moreover, a harness with a plurality of tubular receptacles could be purchased and then cut up into single tubular receptacle harnesses if so desired for reducing an end user's costs.

The inward extension and the outward extension from the tubular receptacle sidewall may be any suitable size or shape to provide a flange-like function.

The inward extension from the tubular receptacle sidewall may extend parallel or at a non-parallel angle relative to the base of the harness. When extending at a non-parallel angle it will typically be within 45 degrees to 135 degrees relative to the base. Greater or lesser angles are also feasible.

The inward extension may be substantially continuous or discontinuous. For example, an O-shaped inward extension is continuous without any ends. A C-shaped inward extension is continuous with two ends. Furthermore, the inward extension may comprise a plurality of discrete inward extension elements, for example 3, 4, 5, 6, 7, 8, 9 or more discrete inward extension elements. The plurality of discrete inward extension elements may be located symmetrically or asymmetrically along the sidewall. The size and shape of the plurality of discrete inward extension elements need not be uniform and may vary as desired.

The outward extension from the tubular receptacle sidewall may extend parallel or at a non-parallel angle relative to the base of the harness. When extending at a non-parallel angle it will typically be within 45 degrees to 135 degrees relative to the base. Greater or lesser angles are also feasible.

The outward extension may be substantially continuous or discontinuous. For example, an O-shaped outward extension is continuous without any ends. A C-shaped outward extension is continuous with two ends. Furthermore, the outward extension may comprise a plurality of discrete outward extension elements, for example 3, 4, 5, 6, 7, 8, 9 or more discrete outward extension elements. The plurality of discrete outward extension elements may be located symmetrically or asymmetrically along the sidewall. The size and shape of the plurality of discrete outward extension elements need not be uniform and may vary as desired.

The harness will typically be elastically deformable. To allow for insertion of a squib charge into the tubular receptacle the inward extension and/or the sidewall of the tubular receptacle will have the ability to elastically deform such that the receiving aperture defined by the inward extension is elastically deformed from a first aperture size that obstructs insertion of the squib charge to a second aperture size that allows insertion of the squib charge. Once the squib charge is inserted the receiving aperture may elastically return to the first aperture size or may return to a third aperture size that is defined by the capture of the squib charge within the tubular receptacle. The third aperture size would be smaller than the second aperture size and larger than the first aperture size. In practice, to insert the squib charge into the tubular receptacle, the squib charge is co-axially aligned with the tubular receptacle and positioned to abut the inward extension. Applying manual force to push the squib charge towards the harness base causes elastic deformation of the inward extension and/or the sidewall changing the receiving aperture size to allow the squib charge to be inserted into the tubular receptacle. Additionally, the harness base may flex to effect the receiving aperture size. Materials with elastic properties and techniques for their use in manufacturing are well known. Accordingly, any such material may be used to produce the harness. Plastics and metals are examples of useful materials. Examples of useful plastics include thermoplastic, thermoset and elastomer polymers. In another example, a polyurethane, a polyvinyl chloride, and a styrene polymer compound have been tested and all three have been found to support a useful harness structure.

The outward extension and the sidewall aperture cooperate to allow electrical wires from a squib charge to exit the tubular receptacle and to allow the electrical wires to be spooled around the sidewall proximal to the junction of the sidewall and the base. The sidewall aperture may be any gap, hole, channel, slit or other suitable opening to allow electrical wires to exit the tubular receptacle. In the absence of a sidewall aperture, electrical wires can run along an axially extending groove in the inner surface of the sidewall and exit from the rim of the sidewall.

The outward extension defines a channel or groove for winding up slack of electrical wires and then the wires are directed radially from the tubular receptacle to periphery of the harness to connect with a triggering device. Once wires extending to periphery are taped down the wires remain stationary and prevent wire portions from looping over squib with risk of wire fragments exploding outward.

A theatrical bag for containing flowable special effects media may be made of any material that provides suitable rupture or burst due to an explosion from a squib charge. The theatrical bag may contain any desired flowable material including liquids, pastes, and powders.

The foam pad may be produced with or without adhesive backing. An advantage of adhesive backing is to be able to fix the foam pad to the body or undershirt allowing force of explosion to be distributed across the body immediately instead of hanging loose and generating momentum before striking body.

Adhesive double-sided tapes may be substituted with other suitable fastening products including for example glues, pastes, plasters, snaps, buttons, loop-and-hook fasteners, tongue and groove fasteners, magnets and the like.

Illustrative embodiments that are described with respect to actors are not limiting, and it will be understood that the harness and its use within a bullet hit device may be used by any wearer.

Still further equivalents, variants, modifications or combinations thereof are contemplated and will be apparent to the person of skill in the art.

What is claimed is:

1. A harness for receiving a special effects squib charge, comprising:

a base bound by opposing first and second surfaces joined at a perimeter;

a tubular sidewall extending from the first surface of the base to form a tubular receptacle;

an inward extension from the tubular sidewall defining a receiving aperture, the receiving aperture sized to be elastically deformed to allow insertion of the squib charge; and a distance between the base and the inward extension sized to be substantially equal to the axial length of the squib charge.

2. The harness of claim 1, wherein the sidewall comprises a sidewall aperture.

3. The harness of claim 2, wherein the sidewall aperture is a gap that extends along an entire axial length of the sidewall.

4. The harness of claim 1, further comprising an outward extension from the sidewall, the outward extension defining a channel substantially parallel to the base surface.

5. The harness of claim 4, wherein the outward extension extends in a plane substantially parallel to the first surface of the base.

6. The harness of claim 1, wherein the harness is made of injection molded plastic.

7. The harness of claim 1, wherein the base is a circular shape.

8. The harness of claim 1, wherein a radial cross-section of the tubular receptacle is a circular shape.

9. The harness of claim 1, wherein the distance between opposing points of a radial cross-section of the tubular receptacle is substantially equal to the distance between opposing points of a radial cross-section of the squib charge.

10. The harness of claim 1, wherein the inward extension extends in a plane substantially parallel to the plane of the first surface of the base.

11. The harness of claim 1, further comprising a plate coupled to the second surface of the base, the plate sized to be larger than a radial cross-section of the tubular receptacle, the plate resistant to an explosion upon detonation of the squib charge.

12. The harness of claim 11, wherein the plate is a metal plate.

13. The harness of claim 12, wherein the plate is co-axially aligned with the tubular receptacle.

14. The harness of claim 13, further comprising a foam pad coupled to the second surface of the base.

15. The harness of claim 14, wherein the foam pad is larger than the plate.

16. The harness of claim 14, wherein the foam pad is co-axially aligned with the plate.

17. The harness of claim 1, further comprising a sealed plastic bag defining a central pouch containing a special effects medium coupled to the first surface of the base and abutting the rim of the tubular receptacle.

18. The harness of claim 1, the base supports a plurality of tubular receptacles.

19. A kit comprising the harness of claim 1 and instructions for assembly and/or use of the harness as a bullet hit device.

20. The kit of claim 19, further comprising adhesive double sided tape for attaching the bullet hit device to a surface.

* * * * *